United States Patent [19]

Bryan et al.

[11] 4,408,395

[45] Oct. 11, 1983

[54] TEXTILE COT REMOVER AND METHOD OF MAKING AND USING SAME

[75] Inventors: James S. Bryan, Clyde; Ivan Gaster, Hazelwood; Mayo B. Tell, Asheville, all of N.C.; Claude Dunn, Greenville, S.C.

[73] Assignee: Dayco Corporation, Dayton, Ohio

[21] Appl. No.: 333,084

[22] Filed: Dec. 21, 1981

Related U.S. Application Data

[63] Continuation of Ser. No. 125,716, Feb. 28, 1980, abandoned.

[51] Int. Cl.[3] ..... B26B 17/02

[52] U.S. Cl. ..... 30/179; 29/426.5; 30/90.4; 30/185; 83/54; 83/924

[58] Field of Search ..... 29/426.4; 83/13, 54, 83/924; 81/9.51, 360, 364; 30/90.4–91.1, 177, 179, 182, 185–193

[56] References Cited

U.S. PATENT DOCUMENTS

| | | | |
|---|---|---|---|
| 1,107,243 | 8/1914 | Adams | 81/9.5 R |
| 1,181,654 | 5/1916 | Eifel | 81/360 X |
| 1,273,713 | 7/1918 | Aaron | 81/9.5 R |
| 1,375,546 | 4/1921 | Ansley | 81/360 X |
| 2,376,858 | 5/1945 | Barrans et al. | 30/179 |
| 2,590,031 | 3/1952 | Peterson | 30/191 X |
| 4,215,598 | 8/1980 | Walls | 30/179 X |
| 4,227,305 | 10/1980 | Newman | 30/233 X |

*Primary Examiner*—James M. Meister

*Attorney, Agent, or Firm*—Joseph V. Tassone

[57] ABSTRACT

A hand tool for cutting a textile cot from an associated mandrel, method of making such tool, and method of utilizing the tool and removing such a cot from the mandrel are provided wherein such tool is in the form of a pliers-like instrument having a special cutting blade.

2 Claims, 5 Drawing Figures

TEXTILE COT REMOVER AND METHOD OF MAKING AND USING SAME

CROSS REFERENCE TO RELATED APPLICATION

This application is a continuation patent application of its copending parent patent application, Ser. No. 125,716 filed Feb. 28, 1980, now abandoned.

BACKGROUND OF THE INVENTION

1. Field of the Invention

This invention relates to a hand tool for the removal of textile cots from associated mandrels.

2. Prior Art Statement

Textile cots are widely used in the textile industry for drafting or drawing textile fibers to produce yarn, sliver, roving, and the like; and, in the course of using these cots they become worn and must be periodically replaced. Ordinary hand tools, of the type usually found in a mechanic's toolbox, such as, screwdrivers, cutting knives, pliers, and the like are usually employed to remove cots from associated mandrels as they become worn. Particularly in the case of so-called hard base cots, i.e., cots which employ a tubular core or base member made of a material which is comparatively harder than the outer sleevelike working member of the cot it is generally very difficult to remove such cots from their associated mandrels utilizing ordinary hand tools. In addition, cot removal using ordinary hand tools often requires expenditure of substantial time and the associated supporting mandrel of a cot being thus removed is often damaged in the process. Accordingly, the need exists for a simple hand tool for removing cots of different sizes from associated mandrels wherein each cot may be removed in a minimum of time without damage to the cot supporting mandrel.

Expandable jaw pliers, and wrenches are well known in industry and used for various purposes. In addition, it is known to provide a hand tool which amounts to a combination of a pair of pliers and a wrench and such a tool is sold under the trade name of "Plierench" by Plierench Tools, Inc. of Bensenville, Ill.; and basically this tool is a grasping and/or holding tool.

SUMMARY

It is a feature of this invention to provide a simple hand tool for removing textile cots of different sizes from their associated mandrels in a minimum of time while keeping the mandrels substantially intact and free of damage.

Another feature of this invention is to provide a hand tool of the character mentioned particularly adapted to remove so-called hard base cots.

Another feature of this invention is to provide a hand tool of the character mentioned comprised of a plier-like instrument having a pair of members pivotally mounted for movement substantially in one plane and about a pivot having an axis disposed perpendicular to such plane and each of the members has a grasping handle on one side of the pivot and an associated jaw on the opposite side of the pivot and wherein one of the jaws is adjustable to control the distance between the jaws. Such hand tool has a cutting blade detachably fastened to the one jaw with the cutting blade having a cutting edge disposed parallel to the axis of the cot and with the tool being adapted to receive a mandrel having a cot supported thereon between its jaws with the axis of the cot disposed parallel to the cutting edge thereby enabling the cutting blade to cut the cot along its axial length parallel to its axis and thus enable removal of the cot from its mandrel.

Another feature of this invention is to provide a hand tool of the character mentioned particularly adapted to cut cots of different standard sizes.

Another feature of this invention is to provide a hand tool of the character mentioned which also has a positioner provided on one of the members for axially positioning the mandrel and cot thereon relative to the cutting blade of the tool to aszure efficient cutting action.

Another feature of this invention is to provide a tool of the character mentioned which has means for detachably fastening the cutting blade on one jaw for replacement and sharpening purposes.

Another feature of this invention is to provide an improved method of making a hand tool of the character mentioned.

Another feature of this invention is to provide an improved method of cutting a textile cot from an associated mandrel utilizing a hand tool of the character mentioned.

Accordingly, it is an object of this invention to provide an improved hand tool, method of making same, and method of utilizing such a hand tool having one or more of the novel features set forth above or hereinafter shown or described.

Other objects, features, details, uses, and advantages of this invention will be readily apparent from the embodiments thereof presented in the following specification, claims, and drawing.

BRIEF DESCRIPTION OF THE DRAWING

The accompanying drawing shows a present preferred embodiment of this invention, in which.

DETAILED DESCRIPTION

Figure 1:
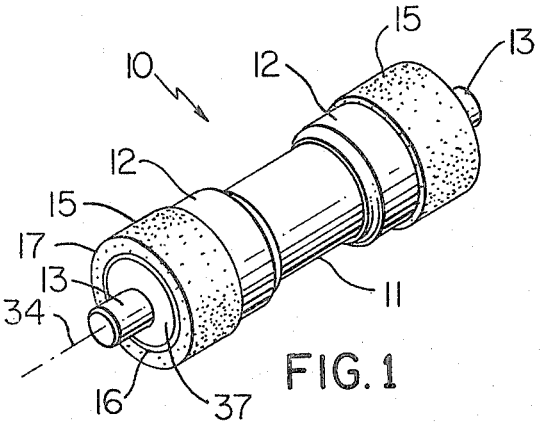
FIG. 1 is a perspective view illustrating a mandrel assembly which has a pair of cots disposed on opposite end portions thereof.
Figure 2:
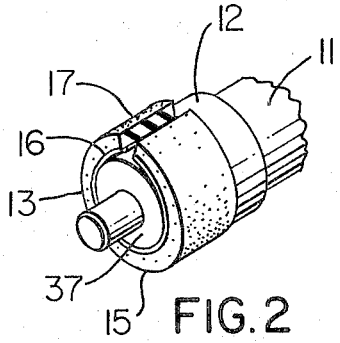
FIG. 2 is a fragmentary view illustrating the forward end portion of the mandrel assembly of FIG. 1 and illustrating the associated cot as cut by the cutting tool of this invention and showing the cut portions of such cot pulled away from each other.

Reference is now made to FIG. 1 of the drawing which illustrates an exemplary cot assembly which is designated generally by the reference numeral 10 and such cot assembly comprises a mandrel or roller 11 having enlarged diameter right circular cylindrical outer end portions 12 and the diameter of each of these portions is often popularly referred to as the bare roller diameter upon which a cot is to be mounted. The cot assembly 10 also has a pair of shafts 13 extending from its opposite ends which are particularly adapted to be rotatably supported on associated textile machinery, for the purpose of rotatably supporting the assembly 10 on such machinery.

The cot assembly 10 comprises a pair of cots each designated by the same reference numeral 15 and each cot is mounted on an associated outer end portion 12 as is known in the art. Each cot is a so-called hard base cot defined by a hard core or base 16 and a comparatively yieldable or resilient outer portion 17. The hardness of the hard rubber used to make the base 16 is such that once it is nicked or cut through a fractional portion of its radial thickness such base tends to separate essentially as illustrated at 20 in FIG. 5 of the drawing.

The outer portion 17 of each cot 15 is the working sleeve thereof and may be made of any suitable hardness and construction depending upon the intended application of the cot. However, regardless of the properties of the core 16 and the outer sleeve 17 of each cot 15 and its application it is necessary to replace the cot 15 periodically as it becomes excessively worn and the preferred technique is to cut the cot away from its mandrel.

Figure 3:
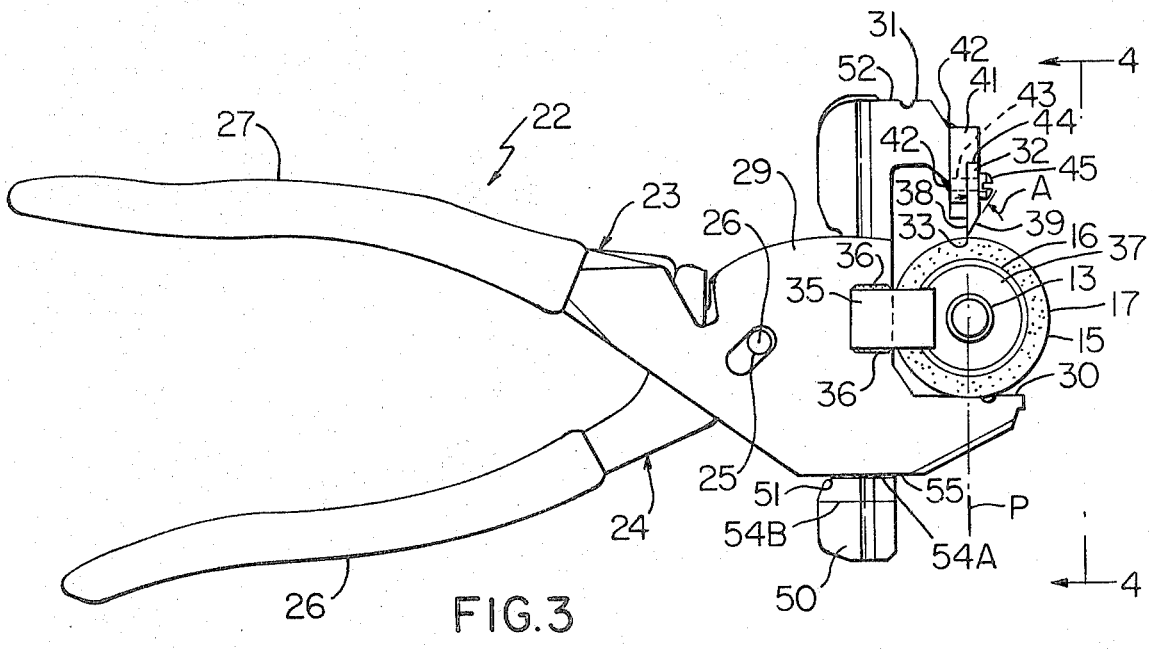
FIG. 3 is a view in elevation illustrating an exemplary embodiment of the tool of this invention.

In accordance with the teachings of this invention, a hand held cutting tool is provided for this purpose and one exemplary embodiment of such a tool is illustrated in FIG. 3 of the drawing and designated generally by the reference numeral 22. The tool 22 is in the form of a pliers-like instrument having a pair of members 23 and 24 pivotally mounted for movement substantially in one plane (such as in the plane of the paper in the illustration of FIG. 3) and about a pivot 25 having an axis 26 disposed perpendicular to such plane.

Each of the members 23 and 24 has a grasping handle 27 and 26 respectively on one side of the pivot and each member has a jaw on the opposite side of such pivot defined as a jaw 30 associated with the member 23 and a jaw 31 associated with the member 24. The jaw 30 is defined as an integral part of member 23. However, the jaw 31 is confined for reciprocating movements by an extension portion 29 of member 23 yet is controlled in its operation by member 24 and handle 26; and, jaw 31 is adjustable to thereby control the distance between the jaws 30 and 31 and as will be described subsequently.

The tool 22 has a cutting blade 32 which is detachably fastened to the one jaw 31 in this example, the disclosed cutting blade has a cutting edge 33 disposed parallel to the axis 26 of the tool 22. The tool 22 is particularly adapted to receive a mandrel, such as mandrel 11 of the cot assembly 10, having an associated cot 15 thereon between its jaws 30 and 31 with the central axis 34 of the cot 15 (which coincides with the central axis of the mandrel 11) disposed substantially parallel to the cutting edge 33. Accordingly, upon moving the handles 27 and 26 toward each other to operate the tool 22, the cutting blade 32 operates to cut the cot 15 along its axial length parallel to its axis 34 and thereby enable removal of such cot from its associated mandrel.

The cutting edge 33 of the blade 32 is defined by a pair of cooperating planar surfaces 38 and 39 disposed to define an included angle A therebetween ranging between 25° and 35°. The angle A of surfaces 38 and 39 assures that at least one cut edge of the cot is moved away from its mandral upon cutting thereof.

The tool 22 has a positioner 35 provided on one of the members and such positioner is suitably attached to the member 23 by a pair of welds 36 on opposite edges thereof. The positioner 35 serves as a stop for axially positioning the mandrel 11 and an associated cot supported thereon relative to the cutting blade 32; and, in particular the positioner 35 limits axial movement of the mandrel 11 so that once the mandrel end 37 is urged against the positioner 35, the cot is precisely aligned beneath the cutting blade 32 and basically on a diametral plane P as shown in FIG. 3.

Figure 5:
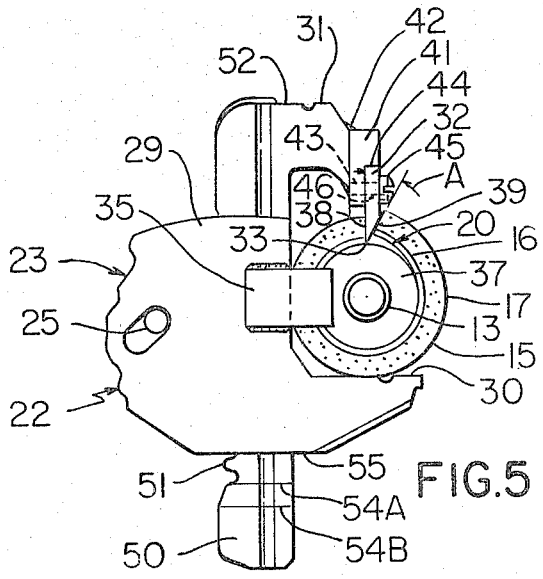
FIG. 5 is a view similar to the right hand portion of FIG. 3 and illustrating a cutting blade of the tool extending through the cot.

Once the handles 27 and 26 are moved toward each other, the cutting blade 32 cuts substantially completely through the thickness of the cot 15 as illustrated in FIG. 5 and across substantially the entire axial length or dimension of such cot. In the case of the cot 15 of this example, which has a hard base 17, the angle A between surfaces 38 and 39 defining the cutting edge 33 provides a liftoff action as shown at 20 in FIG. 5 simultaneously with the cutting of the cot across its full axial length. The innermost edge of the cutting edge 33 may be protected from engaging the portion 12 of the mandrel 11 disposed beneath a cot 15 being cut by a suitable stop 40. The stop 40 will be described subsequently; however, basically such stop limits the distance that the blade penetrates the total thickness of the cot 15. It has been found that with a hard base cot 15, blade penetration to roughly 10 thousandths of an inch from the mandrel end 12 will still provide complete cutting separation as shown at 20 in FIG. 5, and this is due to the physical properties of the hard rubber defining the base 17 of the hard base cot.

The tool 22 is a substantial modification of the commercially available tool identified as "Plierench" in the Backround of the Invention presented in this specification. Basically, this modification comprises the provision of means for supporting and detachably fastening the blade 32 on the adjustable jaw 31. The means for supporting and detachably fastening is defined as a support block 41 which is fixed to the adjustable jaw by any suitable means, such as, welds 42, or the like. The block 41 has a threaded opening 43 provided therein and a stepped positioning surface 44. A threaded screw 45 is adapted to be extended through an opening 46 (FIG. 5) in the blade 32 and into threaded engagement with the threaded opening 43 after positioning the blade 32 against the surface 44 to thereby detachably fasten the blade 32 into position on the block 41 and hence on the adjustable jaw 31.

The jaw 31 has a rectilinear rack-like portion 50 provided with a plurality of spaced teeth 51 and such teeth cooperate with suitable components (not shown) in portion 29 of member 23 of the tool 22 to enable the jaw 31 to be adjusted to a plurality of predetermined positions. The jaw 31 has an L-shaped portion 52 at one end of portion 50 and the portion 52 extends in a direction substantially diametrically opposite the direction of extension of the teeth 51. The jaw 31 has block 41 welded to L-shaped portion 52 thereof by welds 42 as previously described. Thus, the jaw 31 is adjustable to a plurality of predetermined positions through the utilization of the spaced teeth 51 and such positions include a plurality of positions each corresponding to the outside diameter of a standard cot, such as the cot 15 which is to be cut utilizing the tool 22.

The jaw 31 also has a plurality of two marks 54A and 54B provided on its rectilinear portion 50 and each of these marks cooperates with a surface 55 of the tool 22 to indicate an associated one of a plurality of predetermined positions corresponding to the maximum diameter of a standard cot, while making allowances for manufacturing tolerances. In this example of the invention each of the two exemplary marks 54A and 54B corresponds to an associated standard diameter cot which is correlated therewith; however, it is to be understood that any desired number of marks may be provided with each corresponding to a particular size of cot. Each mark 54A and 54B is correlated, by literature available to a user of the tool 22, to each particular type and size of cot which is to be cut at each mark setting, either 54A and 54B.

As previously indicated the blade 32 has stop 40 which is provided to prevent damage to its cutting edge 33. The stop 40 has a stop surface 57 which is particularly adapted to engage an associated enlarged diameter portion 12 of a mandrel 11 before the cutting edge 33 engages portion 12. In this example of the invention the stop 40 is provided as an integrai part of the support block 41. However, it is to be understood that such stop may be provided in any suitable manner. For example, the stop 40 may be provided as a separate part which is suitably attached in position. In addition, shims, or the like, may be employed to precisely control the position of the stop surface 57.

Figure 4:
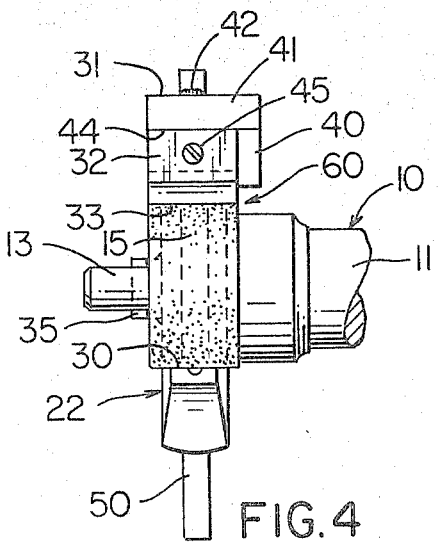
FIG. 4 is a view taken essentially on line 4—4 of FIG. 3.

The dimensional relationships of the various components comprising the tool 22 including the size and arrangement of the blade 32, the disposal of marks 54A and 54B, the disposal of surface 55 and the dimensional position of the stop surface 57 are all correlated so that surface 57 engages the outside surface of the portion 12 before the cutting edge 33 engages such surface whereby the edge 33 is maintained in a substantially sharp condition. The stop 40 limits the distance that the blade penetrates the total thickness of the cot 15 whereby once the blade cuts completely through outer portion 17 and over one half of the thickness of a hard core or base 16 made of hard rubber the cot 15 tends to split apart beneath the cut along its entire axial length. In addition, it will be appreciated that the stop 40 is positioned with respect to the blade 32 so that once a standard cot 15 and its supporting mandrel 11 is disposed against the positioner 35 an axial clearance, as shown at 60 in FIG. 4, is provided between the side edge of the stop and the adjacent edge of the cot.

The use of stop 40 with its stop surface 57 is preferred to prevent damage to the blade edge 33 and to a cot supporting mandrel. However, it will be appreciated that the tool 22 provides an efficient cutting action even if a stop is not employed.

Each of the marks 54A and 54B may be provided on the rectilinear portion 50 utilizing any suitable technique known in the art. For example, each mark may be etched, painted, scribed, or provided by any other suitable technique.

Having presented the detailed construction of tool 22, the description will now proceed with a brief presentation of the manner in which the tool 22 may be employed to cut a particular size cot 15. In particular, the handles 27 and 26 are first moved away from each other to their fully open positions. The rack-like portion 50 of jaw 31 is then manually positioned until a desired mark (54A in this example) is positioned in aligned relation with the surface 55. The handles 27 and 26 are then moved slightly toward each other to thereby, in essence, size set the tool 22 at the position indicated by the mark 54A and which position is the size necessary to cut the cot 15 supported on mandrel 11.

Once the tool 22 is sized and set, as described, movement of the handles 27 and 26 provides corresponding movements of jaws 30 and 31 respectively. The jaws 30 and 31 are then opened and the mandrel 11 with the cot 15 to be cut supported thereon is disposed therebetween with the axis 34 of such cot disposed parallel to the cutting edge 33. The handles 27 and 26 are then manually moved toward each other thereby urging the cutting blade 32 into the cot 15 along its axial length to provide a cut therein parallel to the cot axis and thereby severing the cot along its entire axial length.

This severing action is illustrated in FIG. 5 of the drawing and in the case of a hard base cot, i.e., a cot having a core 16 made of hard rubber, it is only necessary to sever the major portion of the radial thickness with such major portion being defined by the entire thickness of portion 17 of cot 15 and over half of the thickness of core 16. The characteristics and structural properties of the hard rubber core 16 and the angle A between the surfaces 38 and 39 of the cutting edge 33 help to cause the cot to be completely severed with a portion thereof springing away from its mandrel as shown at 20 in FIG. 5. Once the cot 15 is thus cut it is a simple manner to move the handles 27 and 26 away from each other thereby moving the cutting blade 32 out of its cutting position. The mandrel and severed cot may then be withdrawn from within jaws 30 and 31 of the instrument 22 whereupon it is a simple manner to simply peel away or unwrap the cot 15 from its associated end portion 12 of the mandrel 11.

During the process step of the disposing of mandrel 11 with a cot 15 to be cut thereon between the jaws 30 and 31 the mandrel is urged axially against the positioner 35 of the tool 22. This assures precise alignment of the cot 15 beneath the cutting edge 33 along its entire axial length so that upon compressing or urging the handles 27 and 26 toward each other a cut is provided across the entire axial length of the cot 15. In addition, this disposing step positions the cot so that its central axis 34 is basically disposed so that the cut provided by blade 32 is on a diametral plane through the cot 32.

While present exemplary embodiments of this invention, and methods of practicing the same, have been illustrated and described it will be recognized that this invention may be otherwise variously embodied and practiced within the scope of the following claims.

What is claimed is:

1. In a hand tool comprising a pliers-like instrument having a pair of members pivotally mounted for movement substantially in one plane and about a pivot having an axis disposed perpendicular to said plane, each of said members having a grasping handle on one side of said pivot and an associated jaw on the opposite side of said pivot, the improvement in said tool adapting same for cutting a textile cot from an associated mandrel and comprising a cutting blade, means detachably fastening said blade to one jaw with a cutting edge thereof disposed parallel to said axis, said tool being adapted to receive a mandrel having a cot supported thereon between its jaws with the axis of said cot disposed parallel to said cutting edge, a positioner provided on one of said members for axially positioning said mandrel and its cot relative to said blade, said tool being adapted to be operated by manually moving said handles toward each other causing said cutting blade to cut said cot along its axial length parallel to the cot axis and thus enable removal of said cot from its mandrel, and a stop carried by said one jaw adjacent said blade on the side thereof opposite the side thereof where said positioner is located, said stop being adapted to engage said mandrel outboard of its cot to stop said cutting edge before it engages said mandrel when said blade is cutting said cot whereby said cot is positioned by said positioner intermediate said positioner and said stop.

2. A tool as set forth in claim 1 and further comprising means attaching said positioner to said one member.

* * * * *